US012042708B1

(12) United States Patent
Waters, Jr.

(10) Patent No.: US 12,042,708 B1
(45) Date of Patent: Jul. 23, 2024

(54) WRESTLING TRAINING HARNESS

(71) Applicant: John Waters, Jr., Flowery Branch, GA (US)

(72) Inventor: John Waters, Jr., Flowery Branch, GA (US)

( * ) Notice: Subject to any disclaimer, the term of this patent is extended or adjusted under 35 U.S.C. 154(b) by 317 days.

(21) Appl. No.: 17/714,194

(22) Filed: Apr. 6, 2022

(51) Int. Cl.
*A63B 69/00* (2006.01)
*A63B 21/00* (2006.01)
*A63B 21/04* (2006.01)
*A63B 21/055* (2006.01)

(52) U.S. Cl.
CPC ..... *A63B 69/0059* (2013.01); *A63B 21/0428* (2013.01); *A63B 21/0552* (2013.01); *A63B 21/154* (2013.01); *A63B 21/4007* (2015.10); *A63B 21/4013* (2015.10); *A63B 69/0062* (2020.08); *A63B 2225/09* (2013.01); *A63B 2244/108* (2013.01)

(58) Field of Classification Search
CPC ..... A63B 21/0425; A63B 21/0552; A63B 21/154; A63B 21/4007; A63B 21/4013; A63B 69/0059; A63B 69/0062; A63B 2225/09; A63B 2244/108
See application file for complete search history.

(56) References Cited

U.S. PATENT DOCUMENTS 2,613,932 A * 10/1952 Manners ..... A63B 21/4013 482/124
3,411,500 A * 11/1968 Gatts ..... A63B 21/4009 600/20
4,961,573 A 10/1990 Wehrell
5,647,827 A * 7/1997 Gutkowski ..... A63B 21/4025 482/122
5,683,336 A 11/1997 Pape
5,716,307 A * 2/1998 Vadher ..... A63B 21/4043 482/125
5,993,362 A * 11/1999 Ghobadi ..... A63B 21/4015 482/121
6,099,446 A * 8/2000 Johnson ..... A63B 21/4005 482/124
6,287,242 B1 * 9/2001 Fray ..... A63B 21/4015 482/121
7,314,437 B2 1/2008 Frappier
7,608,026 B1 * 10/2009 Nicassio ..... A63B 21/4015 482/121
7,744,511 B2 * 6/2010 Grigoriev ..... A63B 21/4011 482/121
8,083,644 B2 * 12/2011 Purdy ..... A41D 31/18 482/4

(Continued)

FOREIGN PATENT DOCUMENTS

WO 1997041926 11/1997

*Primary Examiner* — Joshua Lee

(57) ABSTRACT

The wrestling training harness comprises an upper body harness, a pair of leg sleeves, a pair of ankle sleeves, and a pair of tension cables. The wrestling training harness may be a training aid adapted for use by an athlete. The wrestling training harness may be adapted to force a ready position stance and may build strength in the legs and core section. The upper body harness, the pair of leg sleeves, and the pair of ankle sleeves may be adapted to be worn by the athlete and the pair of tension cables may provide tension to force the ready position stance. As a non-limiting example, the athlete may be a wrestler.

17 Claims, 4 Drawing Sheets

(56) References Cited

U.S. PATENT DOCUMENTS

| | | | | |
|---|---|---|---|---|
| D698,877 | S | 2/2014 | Calvin | |
| 8,968,166 | B2 * | 3/2015 | Cranke | A63B 21/0557 482/121 |
| 9,629,405 | B2 * | 4/2017 | Cornish | A41F 9/00 |
| 9,764,180 | B2 * | 9/2017 | Bybee | A63B 21/0442 |
| 10,127,828 | B2 * | 11/2018 | Arnold | G09B 19/0038 |
| 10,667,941 | B1 * | 6/2020 | Breibart | A63B 21/4007 |
| 11,331,529 | B1 * | 5/2022 | Cranke | A63B 21/4021 |
| 2007/0015642 | A1 | 1/2007 | Demeniuk | |
| 2007/0135279 | A1 * | 6/2007 | Purdy | A63B 21/4025 482/121 |
| 2010/0144490 | A1 * | 6/2010 | Purdy | A63B 21/4007 2/69 |
| 2012/0202658 | A1 * | 8/2012 | Menefee, Sr. | A63B 21/4005 482/124 |
| 2013/0143723 | A1 * | 6/2013 | Bender | A63B 21/02 482/121 |
| 2013/0333097 | A1 * | 12/2013 | Cranke | A63B 21/0557 2/300 |
| 2016/0074699 | A1 * | 3/2016 | Walter | A63B 23/12 482/129 |
| 2020/0147469 | A1 | 5/2020 | Rowland | |

* cited by examiner

WRESTLING TRAINING HARNESS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of athletic training equipment, more specifically, a wrestling training harness.

Summary of Invention

The wrestling training harness comprises an upper body harness, a pair of leg sleeves, a pair of ankle sleeves, and a pair of tension cables. The wrestling training harness may be a training aid adapted for use by an athlete. The wrestling training harness may be adapted to force a ready position stance and may build strength in the legs and core section. The upper body harness, the pair of leg sleeves, and the pair of ankle sleeves may be adapted to be worn by the athlete and the pair of tension cables may provide tension to force the ready position 23 stance. As a non-limiting example, the athlete may be a wrestler.

An object of the invention is to provide a training harness that force an athlete to maintain a ready position stance.

Another object of the invention is to provide an upper body harness, a pair of leg sleeves, and a pair of ankle sleeves that may be donned by the athlete.

A further object of the invention is to provide a pair of tension cables that may couple to the upper body harness, leg sleeves, and ankle sleeves on each side of the athlete to apply tension that maintain the ready position stance.

Yet another object of the invention is to provide a retraction unit on each tension cable such that a knob on each retraction unit may control how much tension is applied and may 14 release the tension when pushed.

These together with additional objects, features and advantages of the wrestling training harness will be readily apparent to those of ordinary skill in the art upon reading the following detailed description of the presently preferred, but nonetheless illustrative, embodiments when taken in conjunction with the accompanying drawings.

In this respect, before explaining the current embodiments of the wrestling training harness in detail, it is to be understood that the wrestling training harness is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the wrestling training harness.

It is therefore important that the claims be regarded as including such equivalent construction insofar as they do not depart from the spirit and scope of the wrestling training harness. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
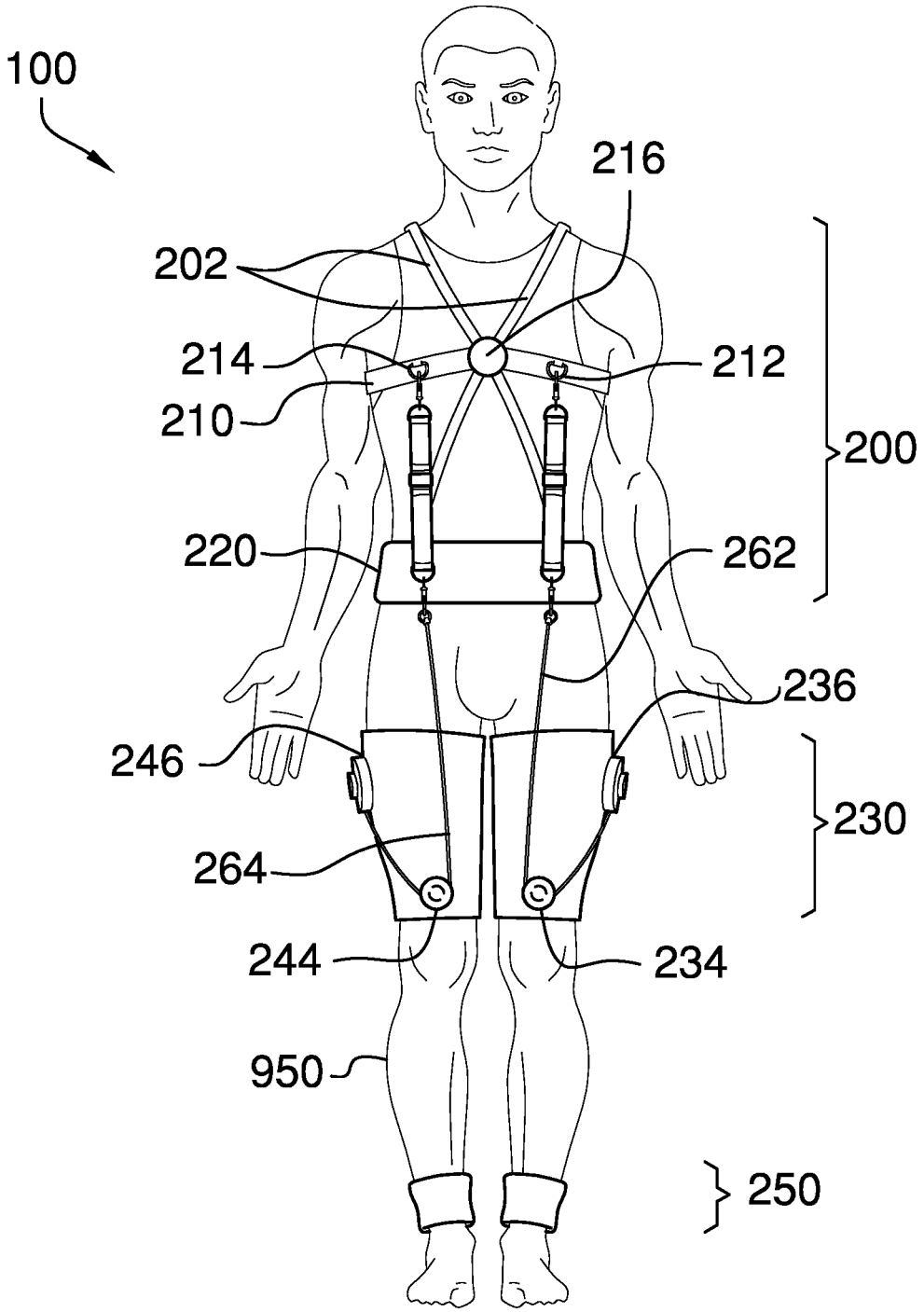
FIG. 1 is a front view of an embodiment of the disclosure.
Figure 2:
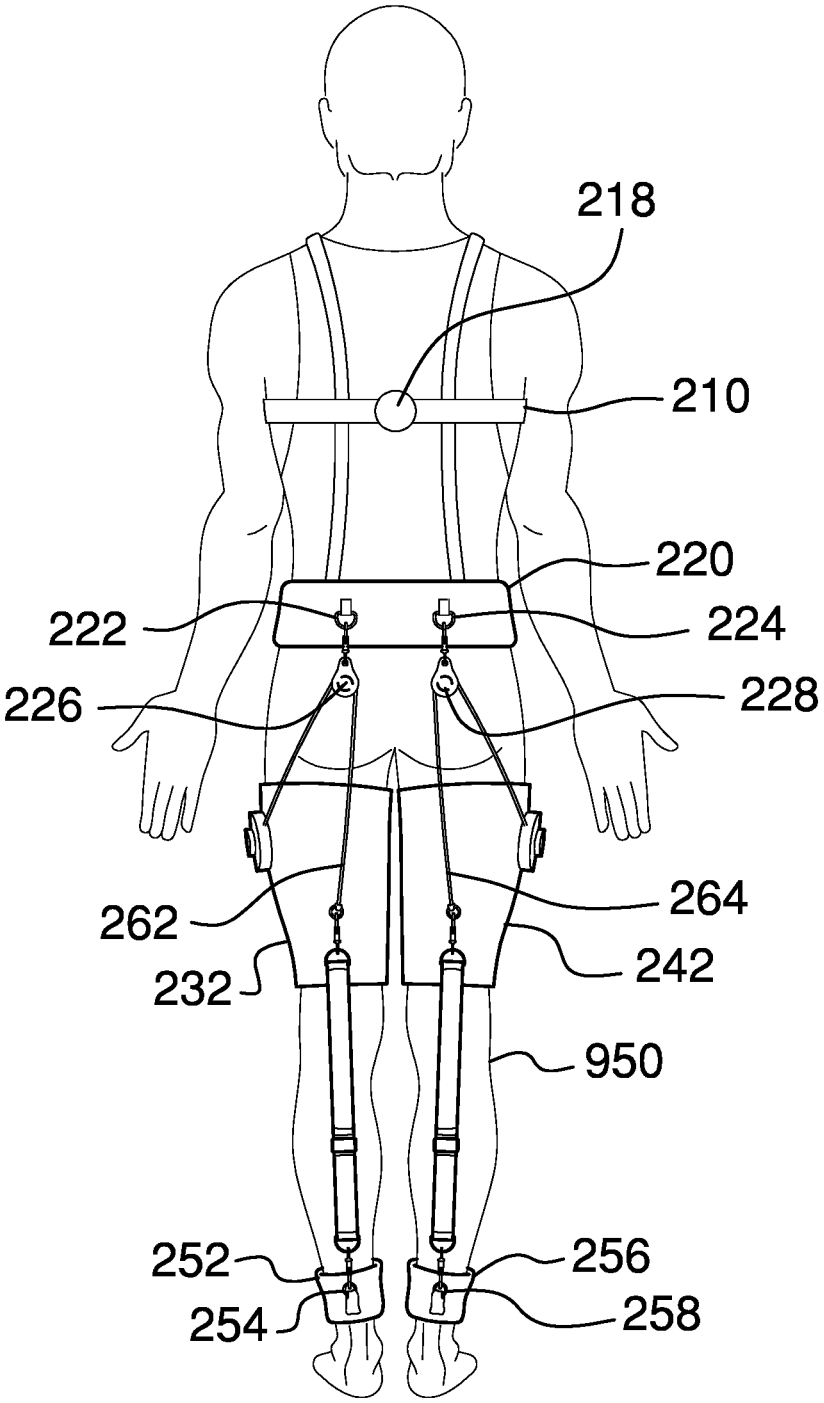
FIG. 2 is a rear view of an embodiment of the disclosure.
Figure 3:
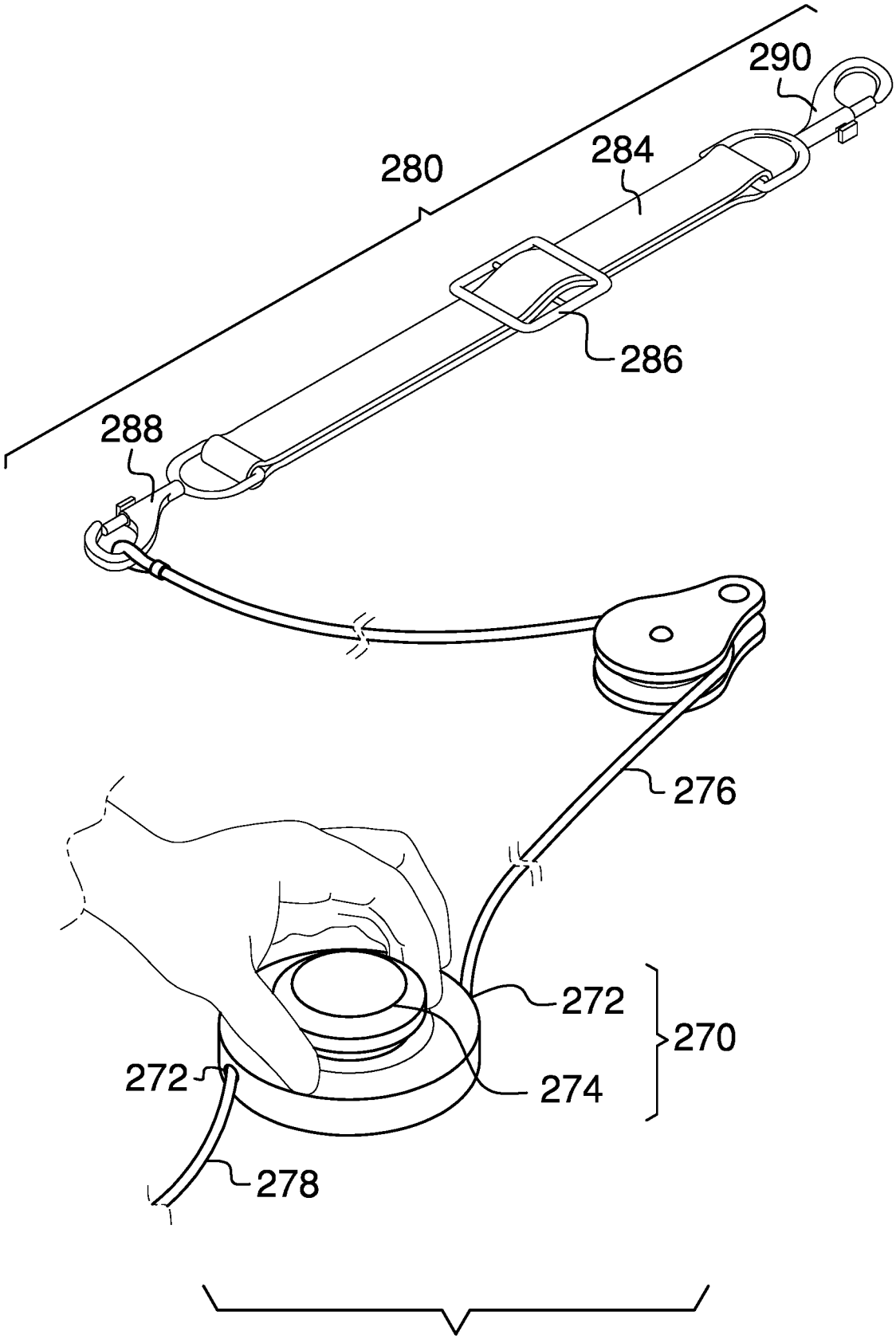
FIG. 3 is a detail view of an embodiment of the disclosure illustrating a portion of a tension cable.
Figure 4:
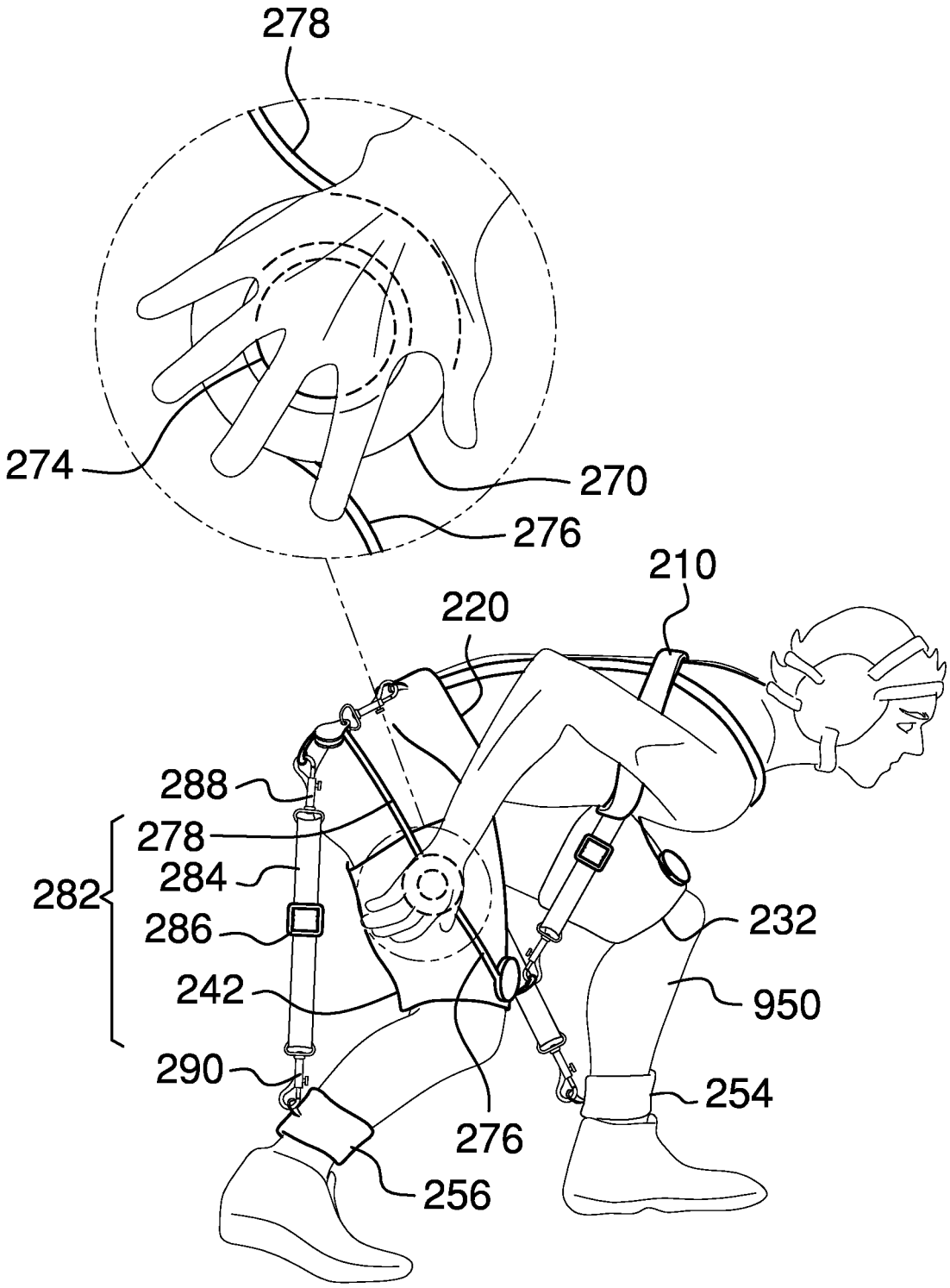
FIG. 4 is an in-use view of an embodiment of the disclosure.

Detailed reference will now be made to a first potential embodiment of the disclosure, which is illustrated in FIGS. 1 through 4.

The wrestling training harness 100 (hereinafter invention) comprises an upper body harness 200, a pair of leg sleeves 230, a pair of ankle sleeves 250, and a pair of tension cables. The invention 100 may be a training aid adapted for use by an athlete 950. The invention 100 may be adapted to force a ready position stance and may build strength in the legs and core section. The upper body harness 200, the pair of leg sleeves 230, and the pair of ankle sleeves 250 may be adapted to be worn by the athlete 950 and the pair of tension cables may provide tension to force the ready position stance. As a non-limiting example, the athlete 950 may be a wrestler.

The upper body harness 200 may comprise a chest strap 210, a waist belt 220, and a plurality of harness straps 202. The chest strap 210 may be elastic and may be adapted to be worn around the chest in a horizontal orientation. The waist belt 220 may be adapted to be worn around the waist in a horizontal orientation. The plurality of harness straps 202 may be flexible straps that couple to the chest strap 210 and to the waist belt 220. As a non-limiting example, the plurality of harness straps 202 may be woven nylon straps. A first end of the plurality of harness straps 202 may be coupled to the rear of the waist belt 220. The plurality of harness straps 202 may extend upwards and may be adapted to pass over the shoulders. The plurality of harness straps 202 may then cross at the front center of the chest strap 210 and may extend downwards. A second end of the plurality of harness straps 202 may be coupled to the front of the waist belt 220. The plurality of harness straps 202 may be coupled to the front center of the chest strap 210 at the center of the chest.

A chest pad 216 may be coupled to the chest strap 210 and the plurality of harness straps 202 where the chest strap 210 and the plurality of harness straps 202 cross on the front of the chest. The chest pad 216 may comprise a cushioning pad on the rear side of the chest pad 216. The chest strap 210 may comprise a pair of chest D rings that are located on the front of the chest strap 210 and positioned on either side of center. A back pad 218 located at the rear center of the chest strap 210 may provide cushioning at the rear of the chest strap 210.

The waist belt 220 may be adapted to be worn around the waist. In some embodiments, the waist belt 220 may be elastic or may be otherwise adjustable in size. The waist belt 220 may comprise a pair of waist D rings. The pair of waist D rings may be located on the rear of the waist belt 220 and may be positioned on either side of center. A pair of waist belt pulleys may be suspended from the pair of waist D rings. A left waist pulley 226 may be suspended from the waist belt 220 via a left waist D ring 222 and a right waist pulley 228 may be suspended from the waist belt 220 via a right waist D ring 224.

The pair of leg sleeves 230 may comprise a left leg sleeve and a right leg sleeve 242. The left leg sleeve 232 may be adapted to be worn around the left thigh. The left leg sleeve may comprise a left leg pulley 234. The left leg pulley 234 may be located on the lower front of the left leg sleeve 232. The left leg sleeve 232 may comprise a left leg retraction unit coupler 236. The left leg retraction unit coupler 236 may be located on the upper left of the left leg sleeve 232. The right leg sleeve 242 may be adapted to be worn around the right thigh. The right leg sleeve 242 may comprise a right leg pulley 244. The right leg pulley 244 may be located on the lower front of the right leg sleeve 242. The right leg sleeve 242 may comprise a right leg retraction unit coupler 246. The right leg retraction unit coupler 246 may be located on the upper right of the right leg sleeve 242.

The pair of ankle sleeves 250 may comprise a left ankle sleeve 252 and a right ankle sleeve 256. The left ankle sleeve 252 may be adapted to be worn around the left ankle. The left ankle sleeve 252 may comprise a left ankle D ring 254. The left ankle D ring 254 may be located on the rear of the left ankle sleeve 252. The right ankle sleeve 256 may be adapted to be worn around the right ankle. The right ankle sleeve 256 may comprise a right ankle D ring 258. The right ankle D ring 258 may be located on the rear of the right ankle sleeve 256.

The pair of tension cables may comprise a left tension cable 262 and a right tension cable 264. An individual tension cable selected from the left tension cable 262 and the right tension cable 264 may comprise a retraction unit 270, a first cable 276, a second cable 278, a first strap 280, and a second strap 282.

The retraction unit 270 may couple to the left leg retraction unit coupler 236 on the left leg sleeve 232 or to the right leg retraction unit coupler 246 on the right leg sleeve 242. In some embodiments, the retraction unit 270 may be detachable. The retraction unit 270 may couple to the first cable 276 and to the second cable 278 and may be operable to retract the first cable 276 and the second cable 278 into the retraction unit 270 when a tension knob 274 on the retraction unit 270 is rotated, thus applying tension to the individual tension cable. The retraction unit 270 may release the tension and allow the first cable 276 and the second cable 278 to extend from within the retraction unit 270 when the tension knob 274 is pushed. The first cable 276 and the second cable 278 may pass through a pair of cable apertures 272 on the sides of the retraction unit 270 enclosure. In some embodiments, the first cable 276 and the second cable 278 may be opposite ends of a single cable.

The first strap 280 may couple to the free end of the first cable 276. The second strap 282 may couple to the free end of the second cable 278. Free end may refer to the end of the cable that is not captured within the retraction unit 270.

An individual strap selected from the first strap 280 and the second strap 282 may comprise a center strap 284, a first bolt snap 288, and a second bolt snap 290. The center strap 284 may be a flexible strap that may be coupled at one end to the first bolt snap 288 and at the opposite end to the second bolt snap 290. The center strap 284 may comprise a length adjuster 286 such that the overall length of the center strap 284 may be adjustable.

The first bolt snap 288 may be operable to couple the individual strap to a loop on the individual tension cable. The second bolt snap 290 may be left free to couple to the chest strap 210 or to one of the pair of ankle sleeves 250.

The pair of tension cables may be coupled to the upper body harness 200, the pair of leg sleeves 230, and the pair of ankle sleeves 250 in order to enforce the ready position stance.

The second bolt snap 290 of the first strap 280 on the left tension cable 262 may be coupled to a left chest D ring 212 selected from the pair of chest D rings. The first strap 280 on the left tension cable 262 may extend downwards from the left chest D ring 212 towards the left leg sleeve 232 and the first bolt snap 288 of the first strap 280 may couple to the first cable 276 of the left tension cable 262. The first cable 276 of the left tension cable 262 may pass through the left leg pulley 234 and may be directed towards the retraction unit 270. The first cable 276 of the left tension cable 262 may enter the retraction unit 270 and wrap around the internal reel of the retraction unit 270. The second cable 278 of the left tension cable 262 may emerge from the opposite side the retraction unit 270 and may extend up towards the rear of the waist belt 220.

The second cable 278 of the left tension cable 262 may pass through the left waist pulley 226 and maybe directed downwards towards the left ankle sleeve 252. The second cable 278 of the left tension cable 262 may couple to the first bolt snap 288 of the second strap 282 on the left tension cable 262. The second bolt snap 290 of the second strap 282 on the left tension cable 262 may be coupled to the left ankle D ring 254 on the left ankle sleeve 252.

The second bolt snap 290 of the first strap 280 on the right tension cable 264 may be coupled to a right chest D ring selected from the pair of chest D rings. The first strap 280 on the right tension cable 264 may extend downwards from the right chest D ring 214 towards the right leg sleeve 242 and the first bolt snap 288 of the first strap 280 may couple to the first cable 276 of the right tension cable 264. The first cable 276 of the right tension cable 264 may pass through the right leg pulley 244 and may be directed towards the retraction unit 270. The first cable 276 of the right tension cable 264 may enter the retraction unit 270 and wrap around the internal reel of the retraction unit 270. The second cable 278 of the right tension cable 264 may emerge from the opposite side the retraction unit 270 and may extend up towards the rear of the waist belt 220. The second cable 278 of the right tension cable 264 may pass through the right waist pulley 228 and may be directed downwards towards the right ankle sleeve 256. The second cable 278 of the right tension cable 264 may couple to the first bolt snap 288 of the second strap 282 on the right tension cable 264. The second bolt snap 290 of the second strap 282 on the right tension cable 264 may be coupled to the right ankle D ring 258 on the right ankle sleeve 256.

With the pair of tension cables coupled to the chest strap 210, the waist belt 220, the pair of leg sleeves 230, and the pair of ankle sleeves 250, the tension knobs 274 on the retraction units 270 may be rotated to apply tension. The pair of tension cables may be adapted to force the athlete 950 into the ready position stance where the torso leans forwards and the legs are bent.

In use, the athlete 950 may don the chest strap 210, the waist belt 220, the pair of leg sleeves 230, and the pair of ankle sleeves 250 and the pair of tension cables may be coupled as previously described. The athlete 950 may assume the ready position stance and the tension knobs 274 on the retraction units 270 may be rotated to apply tension to the invention 100. The tension may force the athlete 950 to remain in the ready position stance. The tension may be released by pushing in on the tension knobs 274.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "aperture" may be an opening in a surface or object. Aperture may be synonymous with hole, slit, crack, gap, slot, or opening.

As used herein, the words "couple", "couples", "coupled" or "coupling", may refer to connecting, either directly or indirectly, and does not necessarily imply a mechanical connection.

As used in this disclosure, "elastic" may refer to a material or object that deforms when a force is applied to stretch or compress the material and that returns to its relaxed shape after the force is removed. A material that exhibits these qualities is also referred to as an elastomeric material.

As used in this disclosure, "flexible" may refer to an object or material which will deform when a force is applied to it, which will not return to its original shape when the deforming force is removed, and which may not retain the deformed shape caused by the deforming force.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used in this disclosure, "horizontal" may be a directional term that refers to a direction that is perpendicular to the local force of gravity. Unless specifically noted in this disclosure, the horizontal direction is always perpendicular to the vertical direction.

As used in this disclosure, "orientation" may refer to the positioning and/or angular alignment of a first object relative to a second object or relative to a reference position or reference direction.

As used in this disclosure a "pulley" may be a wheel with a grooved rim around which a cord (or other form of rope, line, belt, or cable) passes. The pulley may be used to change the direction of a force applied to the cord. In some embodiments, pulleys may be used in groups of two or more to convey a force from one pulley to all other pulleys in the group via a belt. In some embodiments, a pair of opposing pulleys may be used to guide a cord along a path.

As used herein, "ready position" or "ready stance" may refer to the stance of an athlete wherein the feet are separated to shoulder width and facing forward, the knees are bent, the hips are back, and the torso is inclined forward to a position above the knees.

As used herein, "reel" may refer to a cylindrical object with side walls around which a wire, filament, thread, cord, cable, string, line, rope, hose, tubing, or other rope-like object is wound.

As used in this disclosure a "strap" may be a strip of leather, cloth, nylon, plastic, thin metal, rubber, or other flexible material, that is used to fasten, secure, carry, or hold onto something. A strap is sometimes used in conjunction with a buckle or other types of fasteners.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A wrestling training harness comprising:

an upper body harness, a pair of leg sleeves, a pair of ankle sleeves, and a pair of tension cables;

wherein the wrestling training harness is a training aid adapted for use by an athlete;

wherein the wrestling training harness is adapted to force a ready position stance and build strength in the legs and core section of the athlete;

wherein the upper body harness, the pair of leg sleeves, and the pair of ankle sleeves are adapted to be worn by the athlete and the pair of tension cables provide tension to force the ready position stance;

wherein the upper body harness comprises a chest strap, a waist belt, and a plurality of harness straps;

wherein the chest strap is elastic and is adapted to be worn around the chest of the athlete in a horizontal orientation;

wherein the waist belt is adapted to be worn around the waist of the athlete in a horizontal orientation;

wherein the plurality of harness straps are flexible straps that couple to the chest strap and to the waist belt;

wherein a first end of the plurality of harness straps are coupled to a rear of the waist belt;

wherein the plurality of harness straps extend upwards and are adapted to pass over the shoulders of the athlete;

wherein the plurality of harness straps cross at a front center of the chest strap and extend downwards;

wherein a second end of the plurality of harness straps are coupled to a front of the waist belt;

wherein the plurality of harness straps are coupled to the front center of the chest strap;

wherein a chest pad is coupled to the chest strap and the plurality of harness straps where the chest strap and the plurality of harness straps cross at the front center of the chest strap;

wherein the chest pad comprises a cushioning pad on a rear side of the chest pad;

wherein the chest strap comprises a pair of chest D rings that are located on a front of the chest strap and positioned on either side of center.

2. The wrestling training harness according to claim 1 wherein a back pad located at a rear center of the chest strap provides cushioning at a rear of the chest strap.

3. The wrestling training harness according to claim 1 wherein the waist belt is adapted to be worn around the wait of the athlete;

wherein the waist belt comprises a pair of waist D rings;

wherein the pair of waist D rings are located on a rear of the waist belt and are positioned on either side of center;

wherein a pair of waist belt pulleys is suspended from the pair of waist D rings;

wherein a left waist pulley is suspended from the waist belt via a left waist D ring and a right waist pulley is suspended from the waist belt via a right waist D ring.

4. The wrestling training harness according to claim 3 wherein the pair of leg sleeves comprises a left leg sleeve and a right leg sleeve;

wherein the left leg sleeve is adapted to be worn around the left thigh of the athlete;

wherein the left leg sleeve comprises a left leg pulley;

wherein the left leg pulley is located on a lower front of the left leg sleeve;

wherein the left leg sleeve comprises a left leg retraction unit coupler;

wherein the left leg retraction unit coupler is located on a upper left of the left leg sleeve;

wherein the right leg sleeve is adapted to be worn around the right thigh of the athlete;

wherein the right leg sleeve comprises a right leg pulley;

wherein the right leg pulley is located on a lower front of the right leg sleeve;

wherein the right leg sleeve comprises a right leg retraction unit coupler;

wherein the right leg retraction unit coupler is located on an upper right of the right leg sleeve.

5. The wrestling training harness according to claim 4 wherein the pair of ankle sleeves comprises a left ankle sleeve and a right ankle sleeve;

wherein the left ankle sleeve is adapted to be worn around the left ankle of the athlete;

wherein the left ankle sleeve comprises a left ankle D ring;

wherein the left ankle D ring is located on a rear of the left ankle sleeve;

wherein the right ankle sleeve is adapted to be worn around the right ankle of the athlete;

wherein the right ankle sleeve comprises a right ankle D ring;

wherein the right ankle D ring is located on a rear of the right ankle sleeve.

6. The wrestling training harness according to claim 5 wherein the pair of tension cables comprises a left tension cable and a right tension cable;

wherein an individual tension cable selected from the left tension cable and the right tension cable comprises a retraction unit, a first cable, a second cable, a first strap, and a second strap.

7. The wrestling training harness according to claim 6 wherein the retraction unit couples to the left leg retraction unit coupler on the left leg sleeve or to the right leg retraction unit coupler on the right leg sleeve.

8. The wrestling training harness according to claim 7 wherein the retraction unit is detachable.

9. The wrestling training harness according to claim 7 wherein the retraction unit couples to the first cable and to the second cable and is operable to retract the first cable and the second cable into the retraction unit when a tension knob on the retraction unit is rotated, thus applying tension to the individual tension cable;

wherein the retraction unit releases the tension and allows the first cable and the second cable to extend from within the retraction unit when the tension knob is pushed;

wherein the first cable and the second cable pass through a pair of cable apertures on respective sides of the retraction unit.

10. The wrestling training harness according to claim 9 wherein the first cable and the second cable are opposite ends of a single cable.

11. The wrestling training harness according to claim 9 wherein the first strap couples to a free end of the first cable;

wherein the second strap couples to a free end of the second cable.

12. The wrestling training harness according to claim 11 wherein an individual strap selected from the first strap and the second strap comprises a center strap, a first bolt snap, and a second bolt snap;

wherein the center strap is a flexible strap that is coupled at one end to the first bolt snap and at the opposite end to the second bolt snap;

wherein the center strap comprises a length adjuster such that an overall length of the center strap is adjustable.

13. The wrestling training harness according to claim 12 wherein the first bolt snap is operable to couple the individual strap to a loop on the individual tension cable;

wherein the second bolt snap is left free to couple to the chest strap or to one of the pair of ankle sleeves.

14. The wrestling training harness according to claim 13 wherein the pair of tension cables are coupled to the upper body harness, the pair of leg sleeves, and the pair of ankle sleeves in order to enforce the ready position stance.

15. The wrestling training harness according to claim 14 wherein the second bolt snap of the first strap on the left tension cable is coupled to a left chest D ring selected from the pair of chest D rings;

wherein the first strap on the left tension cable extends downwards from the left chest D ring towards the left leg sleeve and the first bolt snap of the first strap couples to the first cable of the left tension cable;

wherein the first cable of the left tension cable passes through the left leg pulley and is directed towards the retraction unit;

wherein the first cable of the left tension cable enters the retraction unit and wraps around an internal reel of the retraction unit;

wherein the second cable of the left tension cable emerges from the opposite side of the retraction unit and extends up towards the rear of the waist belt;

wherein the second cable of the left tension cable passes through the left waist pulley and is directed downwards towards the left ankle sleeve;

wherein the second cable of the left tension cable couples to the first bolt snap of the second strap on the left tension cable;

wherein the second bolt snap of the second strap on the left tension cable is coupled to the left ankle D ring on the left ankle sleeve.

16. The wrestling training harness according to claim 15 wherein the second bolt snap of the first strap on the right tension cable is coupled to a right chest D ring selected from the pair of chest D rings;

wherein the first strap on the right tension cable extends downwards from the right chest D ring towards the right leg sleeve and the first bolt snap of the first strap couples to the first cable of the right tension cable;

wherein the first cable of the right tension cable passes through the right leg pulley and is directed towards the retraction unit;

wherein the first cable of the right tension cable enters the retraction unit and wraps around an internal reel of the retraction unit;

wherein the second cable of the right tension cable emerges from the opposite side of the retraction unit and extends up towards the rear of the waist belt;

wherein the second cable of the right tension cable passes through the right waist pulley and is directed downwards towards the right ankle sleeve;

wherein the second cable of the right tension cable couples to the first bolt snap of the second strap on the right tension cable;

wherein the second bolt snap of the second strap on the right tension cable is coupled to the right ankle D ring on the right ankle sleeve.

17. The wrestling training harness according to claim 16 wherein with the pair of tension cables coupled to the chest strap, the waist belt, the pair of leg sleeves, and the pair of ankle sleeves, the tension knobs on the retraction units are rotated to apply tension;

wherein the pair of tension cables are adapted to force the athlete into the ready position stance where the torso of the athlete leans forwards and the legs of the athlete are bent.

* * * * *